US012535232B2

(12) United States Patent
Zhu

(10) Patent No.: US 12,535,232 B2
(45) Date of Patent: Jan. 27, 2026

(54) HUMIDIFICATION APPARATUS

(71) Applicant: Beijing Xiaomi Mobile Software Co., Ltd., Beijing (CN)

(72) Inventor: Kenan Zhu, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 409 days.

(21) Appl. No.: 18/344,403

(22) Filed: Jun. 29, 2023

(65) Prior Publication Data

US 2024/0328646 A1 Oct. 3, 2024

(30) Foreign Application Priority Data

Mar. 31, 2023 (CN) ..... 202310341843.7

(51) Int. Cl.
*F24F 6/04* (2006.01)
*F24F 13/20* (2006.01)
*F24F 6/00* (2006.01)

(52) U.S. Cl.
CPC ..... *F24F 6/04* (2013.01); *F24F 13/20* (2013.01); *F24F 2006/008* (2013.01); *F24F 2006/046* (2013.01)

(58) Field of Classification Search
CPC .... F24F 6/04; F24F 13/20; F24F 13/24; F24F 2006/008; F24F 2006/046
USPC ..... 261/34.1, 106
See application file for complete search history.

(56) References Cited

U.S. PATENT DOCUMENTS 2,342,469 A * 2/1944 Holm-Hansen ..... F24F 8/133 261/89
5,015,420 A * 5/1991 Jones ..... B01F 23/215 261/106
2021/0172628 A1 6/2021 Park et al.

FOREIGN PATENT DOCUMENTS

CN 205606865 U 9/2016
CN 107401793 A * 11/2017
CN 210118901 U 2/2020
CN 115264702 A 11/2022

OTHER PUBLICATIONS

English Machine Translation of CN 107401793 A (Year: 2017).*

* cited by examiner

*Primary Examiner* — Charles S Bushey
(74) *Attorney, Agent, or Firm* — McCoy Russell LLP

(57) ABSTRACT

A humidification apparatus includes a liquid storage assembly, a humidification assembly and a water pump assembly. The liquid storage assembly includes a container and a mounting base, where the container is provided with a liquid storage cavity and an opening in communication with the liquid storage cavity, the container further includes a stucking portion, the mounting base is detachably connected to the container, the mounting base is configured to cover the opening, and the mounting base includes a mounting cavity and a butting portion. The humidification assembly is provided with a first pipe, and the humidification assembly is mounted in the mounting cavity. The water pump assembly includes a buckling portion and a liquid outlet end, where the buckling portion is snap-fitted to the stucking portion, and the liquid outlet end is in communication with the first pipe.

20 Claims, 9 Drawing Sheets

HUMIDIFICATION APPARATUS

CROSS REFERENCE TO RELATED APPLICATION

The present application claims priority to Chinese Patent Application No. 202310341843.7, filed on Mar. 31, 2023. The entire contents of the above-listed application are hereby incorporated by reference for all purposes.

BACKGROUND

As the production level increases, people's demand for air in the living environment is increasingly high. Typically, air in the living environment is humidified with humidification apparatuses. In a humidification process of a humidifier, the humidifier continuously conveys water from a container to a humidification assembly through a water pump assembly, and then drives fan blades by an electric motor to convey vapor from the humidification assembly to the outside.

SUMMARY

The present disclosure relates to the technical field of humidification, in particular to a humidification apparatus.

According to a first aspect of embodiments of the present disclosure, a humidification apparatus is provided, including: a liquid storage assembly, including: a container provided with a liquid storage cavity and an opening in communication with the liquid storage cavity, where the container further includes a stucking portion arranged in the liquid storage cavity, and a mounting base detachably connected to the container, where at least a part of the mounting base covers the opening, and the mounting base includes a mounting cavity and a butting portion arranged in the mounting cavity; a humidification assembly provided with a first pipe, and a part of the humidification assembly is mounted in the mounting cavity; and a water pump assembly, including a buckling portion and a liquid outlet end, where the buckling portion is snap-fitted to the stucking portion such that the water pump assembly is arranged in the liquid storage cavity, and the liquid outlet end is in communication with the first pipe by means of the butting portion.

BRIEF DESCRIPTION OF THE DRAWINGS

The brief description of the drawings is intended to help understand the drawings of the present disclosure, and the schematic illustrated embodiments of the present disclosure and their description are intended to explain the technical solutions of the present disclosure, which do not constitute an improper limitation on the scope of protection of the present disclosure.

In order to more clearly illustrate the technical solutions of the embodiments of the present disclosure, the accompanying drawings required for the description of the embodiments will be briefly introduced below. Apparently, the accompanying drawings in the following description show merely some embodiments of the present disclosure, and other drawings can be derived from these accompanying drawings by those skilled in the art without creative efforts.

REFERENCE NUMERALS

Figure 1:
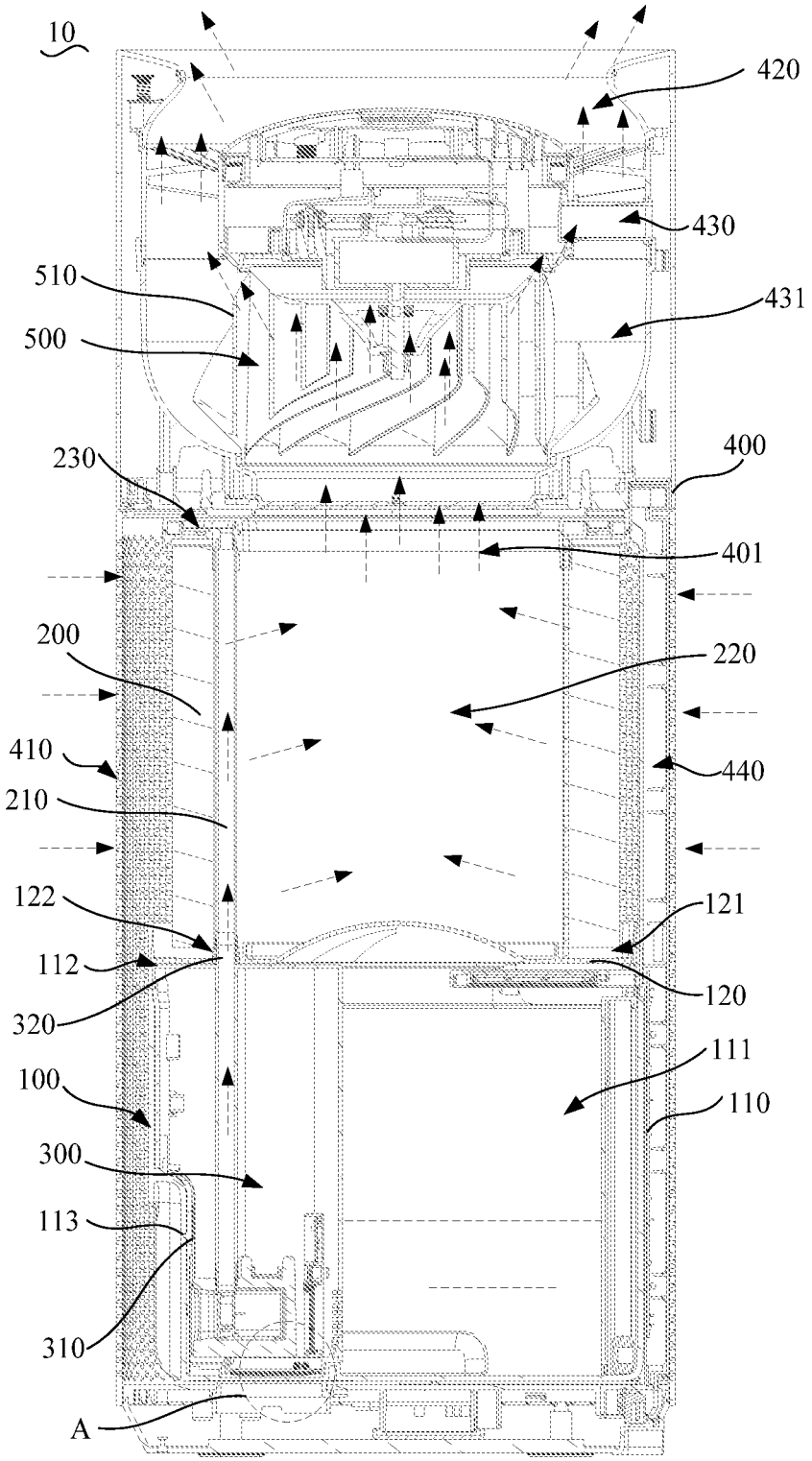
FIG. 1 is a schematic diagram of a humidification apparatus in a humidification state according to one embodiment.

10. humidification apparatus; 11. sealing ring; 100. liquid storage assembly; 101. silencing channel; 1011. outlet; 110. container; 111. liquid storage cavity; 103. second silencing wall; 112. opening; 113. stucking portion; 1131. stucking groove; 114. first limiting protrusion; 1141. guide-in portion; 1142. lug; 1143. limiting groove; 1144. first positioning portion; 115. second limiting recess; 1151. notch; 120. mounting base; 102. first silencing wall; 121. mounting cavity; 1211. outer retaining ring; 1212. inner retaining ring; 122. butting portion; 1221. port; 123. liquid leakage groove; 1231. liquid leakage hole; 1232. water collection groove; 1233. first notch; 124. liquid adding hole; 125. liquid guide protrusion; 130. porous material layer; 200, humidification assembly; 210. first pipe; 220. columnar space; 230. liquid guide groove; 300. water pump assembly; 310. buckling portion; 311. elastic protrusion; 320. liquid outlet end; 321. insertion head; 330. first limiting recess; 331. fitting groove; 332. slot; 333. positioning groove; 340. second limiting protrusion; 350. protective housing; 351. first water inlet hole; 352. cleaning port; 353. second water inlet hole; 354. electrolytic cavity; 360. protective cover; 370. impeller assembly; 380. shock absorption sleeve; 390. impeller cover; 301, reception module; 400, housing assembly; 410. air inlet hole; 420. air outlet; 430. first accommodating cavity; 431. flow channel; 440. second accommodating cavity; 441. second annular space; 401, air duct; 402. liquid adding channel; 450. transmission module; 500. airflow drive assembly; 510. housing.

DETAILED DESCRIPTION

For making the objectives, technical solutions and advantages of the present disclosure clearer, the present disclosure will be described in further detail below in conjunction with the accompanying drawings and particular embodiments. It should be understood that the particular embodiments described here are merely illustrative of the present disclosure and are not intended to limit the scope of protection of the present disclosure.

Unless defined otherwise, all technical and scientific terms used here have the same meaning as commonly understood by those skilled in the art to which the present disclosure belongs. The terms used in the description of the present disclosure here is for the purpose of describing particular embodiments merely and is not intended to limit the present disclosure.

Currently, as the living standard increases, people's demand for air in a living environment is increasingly high. A humidification apparatus can humidify air, and provide people with a comfortable and humid living environment, thus the humidification apparatus plays an increasingly important role in people's life. There are various kinds and various brands of humidification apparatuses, so that there are a large number of humidification apparatuses for consumers to choose from, how to win the favor of consumers and how to improve product competitiveness has become an issue receiving increasing attention from manufacturers of the humidification apparatuses.

However, in the related art, the water pump assembly is difficult to disassemble and assemble and difficult for users to clean, which easily causes bacteria or scale deposits and thus is not conducive to long-term maintenance of air humidification quality.

In view of this, it is necessary to provide a humidification apparatus, of which a water pump assembly is easy to disassemble and assemble and convenient for a user to clean, so to be conducive to long-term maintenance of air humidification quality.

In order to better understand the humidification apparatus of the present disclosure, the humidification apparatus will be described below with reference to the accompanying drawings.

As shown in FIGS. 1 to FIG. 4, in some embodiments of the present disclosure, a humidification apparatus 10 is provided, including a liquid storage assembly 100, a humidification assembly 200 and a water pump assembly 300. The liquid storage assembly 100 includes a container 110 and a mounting base 120. The container 110 is provided with a liquid storage cavity 111 and an opening 112 in communication with the liquid storage cavity 111. The container 110 further includes a stucking portion 113 arranged in the liquid storage cavity 111. The mounting base 120 is detachably connected to the container 110, and at least a part of the mounting base 120 covers the opening 112. The mounting base 120 includes a mounting cavity 121 and a butting portion 122 arranged in the mounting cavity 121. The humidification assembly 200 is provided with a first pipe 210. A part of the humidification assembly 200 is mounted in the mounting cavity 121. The water pump assembly 300 includes a buckling portion 310 and a liquid outlet end 320. The buckling portion 310 is snap-fitted to the stucking portion 113, so as to arrange the water pump assembly 300 in the liquid storage cavity 111. The liquid outlet end 320 is in communication with the first pipe 210 by means of the butting portion 122.

When the humidification apparatus 10 is in use, the humidification assembly 200 is mounted on the mounting base 120 by means of the mounting cavity 121. Liquid in the liquid storage cavity 111 is conveyed from the liquid outlet end 320 to the first pipe 210 by means of the water pump assembly 300, and then flows to the humidification assembly 200, so as to wet the humidification assembly 200. It is convenient to humidify air flowing through the humidification assembly 200 and discharge the humidified air outwards, thus improving air humidity of a living environment and providing people with a comfortable and humid living environment. After the humidification apparatus 10 is used for a long time, the water pump assembly 300 can be taken out from the liquid storage cavity 111 by separating the mounting base 120 from the container 110 and separating the stucking portion 113 from the buckling portion 310, such that a user can conveniently clean the water pump assembly 300. The cleaned water pump assembly 300 can be fixed in the liquid storage cavity 111 by the snap fit of the stucking portion 113 and the buckling portion 310 and then mounting the mounting base 120. In this way, the water pump assembly 300 of the humidification apparatus 10 is easy to disassemble and assemble, and convenient for a user to clean, which is conducive to long-term maintenance of air humidification quality.

It is to be noted that the humidification assembly 200 may be specifically implemented in various forms, for example, a humidifying cotton core, a humidifying foam cotton core, a humidifying wet film, etc.

It is to be noted that the water pump assembly 300 may be specifically implemented in various forms, including a centrifugal pump, an axial flow pump, a mixed flow pump, etc.

In conjunction with any one of the above embodiments, as shown in FIG. 1, in some embodiments, the humidification apparatus 10 further includes a housing assembly 400 and an airflow drive assembly 500. The housing assembly 400 is provided with an air inlet hole 410 and an air outlet 420, an interior of the housing assembly 400 is hollow to form a first accommodating cavity 430 and a second accommodating cavity 440, the first accommodating cavity 430 is close to the air outlet 420, and the second accommodating cavity 440 is located below the first accommodating cavity 430. The airflow drive assembly 500 is arranged in the first accommodating cavity 430 and configured to drive external air to enter the first accommodating cavity 430 through the air inlet hole 410 and to be discharged from the air outlet 420. The humidification assembly 200 is arranged in the first accommodating cavity 430 and is located below the airflow drive assembly 500, and the humidification assembly 200 is configured to humidify air flowing through the humidification assembly. The liquid storage assembly 100 is arranged in the second accommodating cavity 440, and the liquid storage assembly 100 is configured to supply liquid. The water pump assembly 300 is configured to convey liquid in the liquid storage assembly 100 to the humidification assembly 200, so as to wet the humidification assembly 200. In this way, the housing assembly 400 supports the airflow drive assembly 500, the humidification assembly 200 and the liquid storage assembly 100, and the water pump assembly 300 is arranged in the liquid storage cavity 111. During use of the humidification apparatus 10, the airflow drive assembly 500 generates suction force as it is running, so that external air can be sucked into the first accommodating cavity 430 through the air inlet hole 410, and after passing through the humidification assembly 200, the air is humidified by the humidification assembly 200. The humidified air is discharged outwards from the air outlet 420. In this process, the airflow drive assembly 500 actively sucks the air outside of the humidification apparatus 10 for humidification, and conveys the humidified air out of the humidification apparatus 10, such that the humidification capacity of the humidification apparatus 10 is greatly improved, the air humidity of the living space is conveniently increased, and a humid and comfortable living space is provided.

It is to be noted that the housing assembly 400 may be specifically implemented in various forms. For example, the housing assembly is formed of at least one housing, formed by a plurality of plates being stitched together, or formed of a box body and a cover body, etc.

It is to be noted that the airflow drive assembly 500 may be specifically implemented in various forms, including but not limited to an axial fan, a turbo fan, a blower, etc.

In conjunction with the above embodiments, as shown in FIG. 1, in some embodiments, the humidification assembly 200 is formed as tubular, and an interior of the humidification assembly 200 is provided with a columnar space 220. The air inlet hole 410 is arranged at a side wall of the housing assembly 400, and the air outlet 420 is arranged at a top of the housing assembly 400. The air inlet hole 410, the humidification assembly 200, the columnar space 220, the airflow drive assembly 500 and the air outlet 420 are in communication in sequence to form an air duct 401. In this way, the airflow drive assembly 500 is arranged in the air duct 401, the suction force generated by the running airflow drive assembly 500 sucks the external air into the second accommodating cavity 440 through the air inlet hole 410, and after passing through the humidification assembly 200, the air is humidified by the humidification assembly 200. The humidified air passes through the columnar space 220, flows through the airflow drive assembly 500 and is discharged outwards from the air outlet 420, so as to increase the air humidity of the living environment and provide a humid and comfortable living environment for people.

Figure 2:
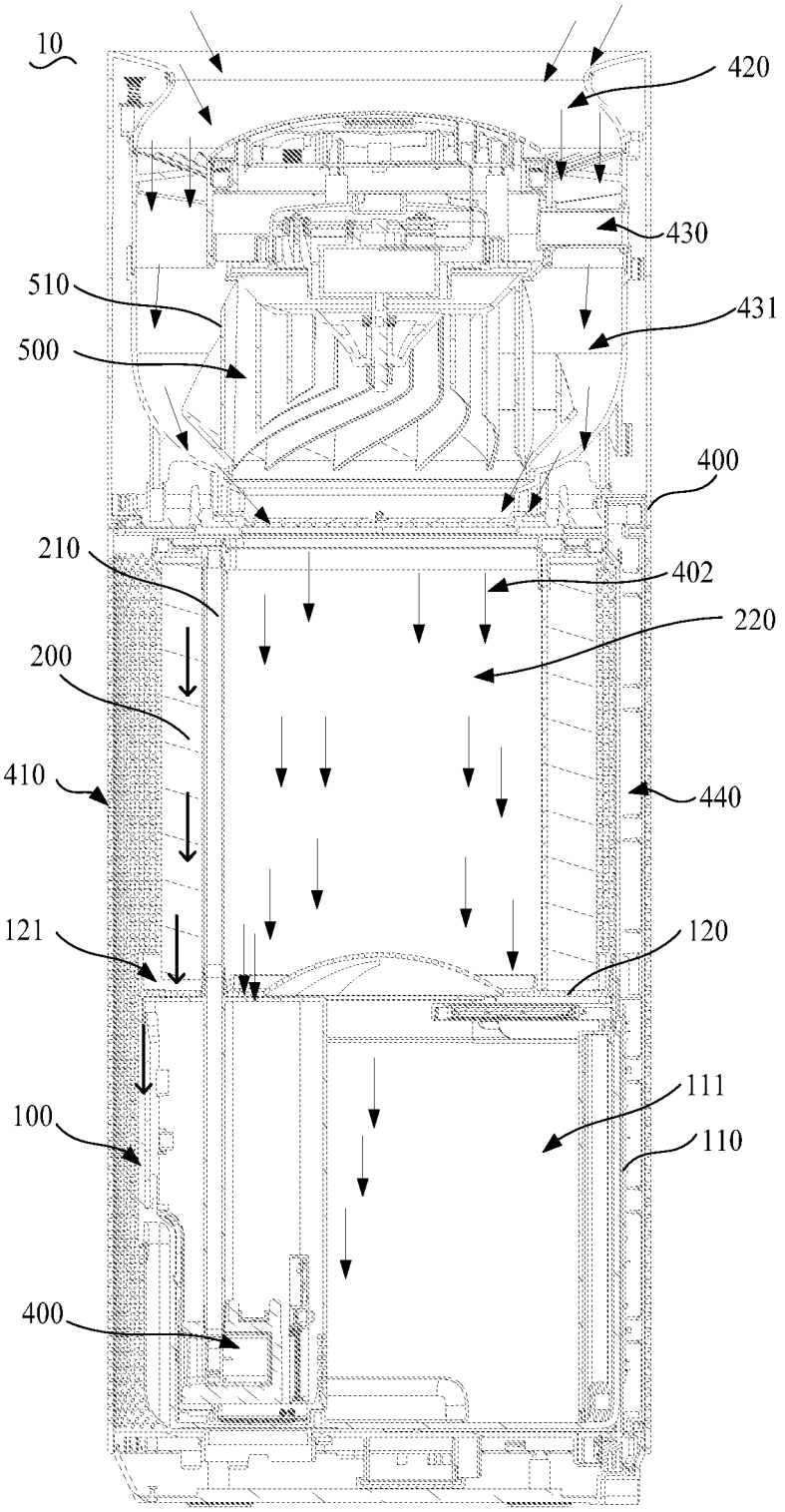
FIG. 2 is a schematic diagram of the humidification apparatus in a liquid adding state shown in FIG. 1.

In conjunction with any one of the embodiments of the columnar space 220, as shown in FIG. 2, in some embodiments, a flow channel 431 is formed between a housing 510 of the airflow drive assembly 500 and an inner wall of the housing assembly 400. A top of the housing assembly 400 is provided with an air outlet 420 which is in no communication with the air outlet 420. The mounting base 120 of the liquid storage assembly 100 is provided with a liquid adding hole 124. The air outlet 420, the flow channel 431, the columnar space 220 and the liquid adding hole 124 are in communication in sequence to form a liquid adding channel 402. In this way, a user can conveniently add liquid into the air outlet 420 from the outside of the humidification apparatus 10, and the liquid flows into the liquid storage cavity 111 through the liquid adding channel 402. Specifically, during liquid addition, the liquid enters the flow channel 431 from the air outlet 420, passes through the flow channel 431 into the columnar space 220, and then flows into the liquid storage cavity 111 from the liquid adding hole 124 for storage, such that the liquid can be conveniently conveyed to the humidification assembly 200 by means of the water pump assembly 300.

In the process of adding the liquid, the liquid storage cavity 111 does not need to be disassembled, and the liquid flows to the liquid storage cavity 111 under the action of gravity. In the process, the liquid flows into the flow channel 431 without damaging the airflow drive assembly 500. The liquid is guided into the liquid adding hole 124 through the columnar space 220 and flows into the liquid storage cavity 111 through the liquid adding hole 124, such that the humidification assembly 200 can be prevented from interfering with a liquid adding speed, so as to improve liquid adding efficiency.

Figure 3:
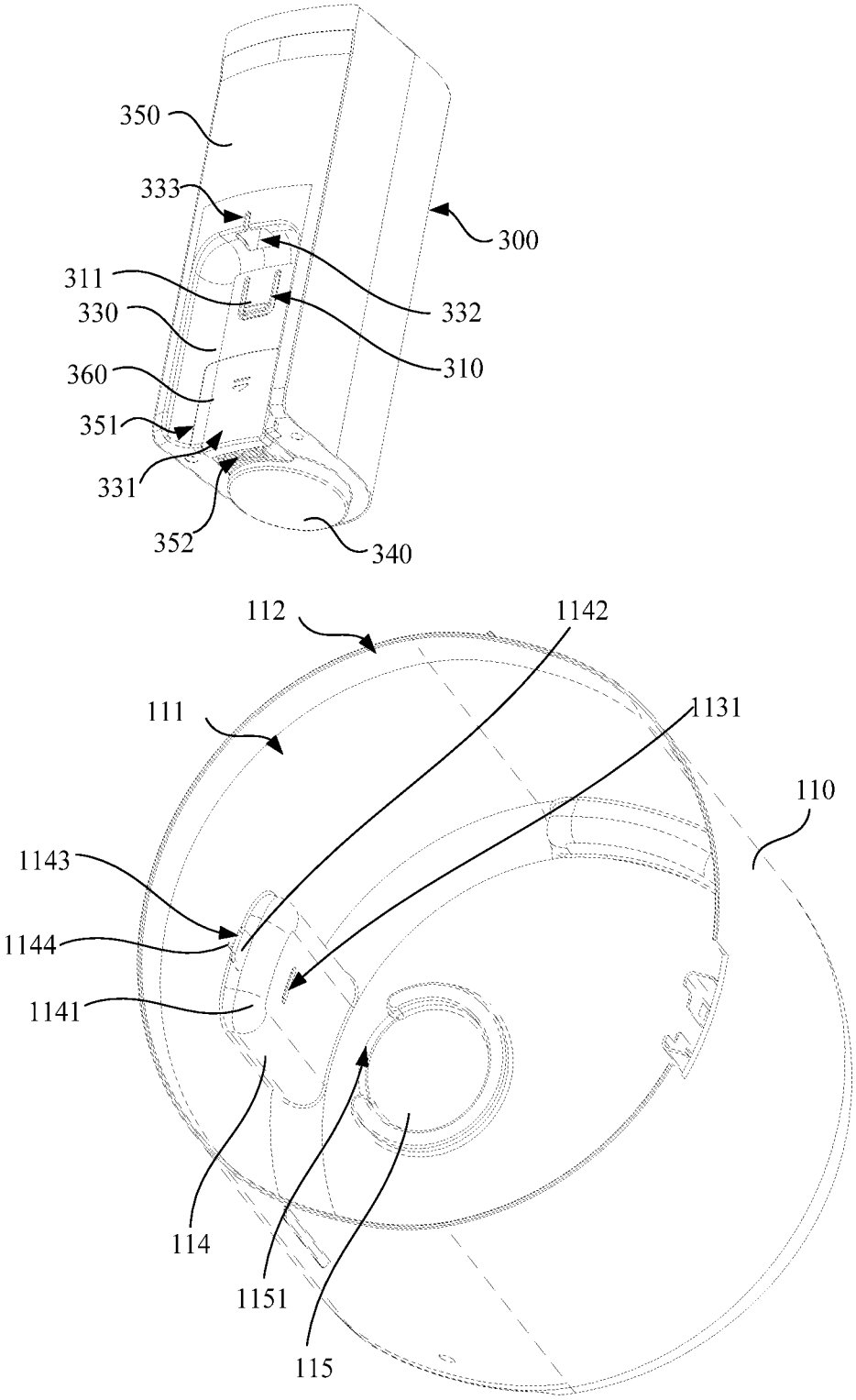
FIG. 3 is a schematic exploded view of a structure of a container and a water pump assembly shown in FIG. 1.
Figure 4:
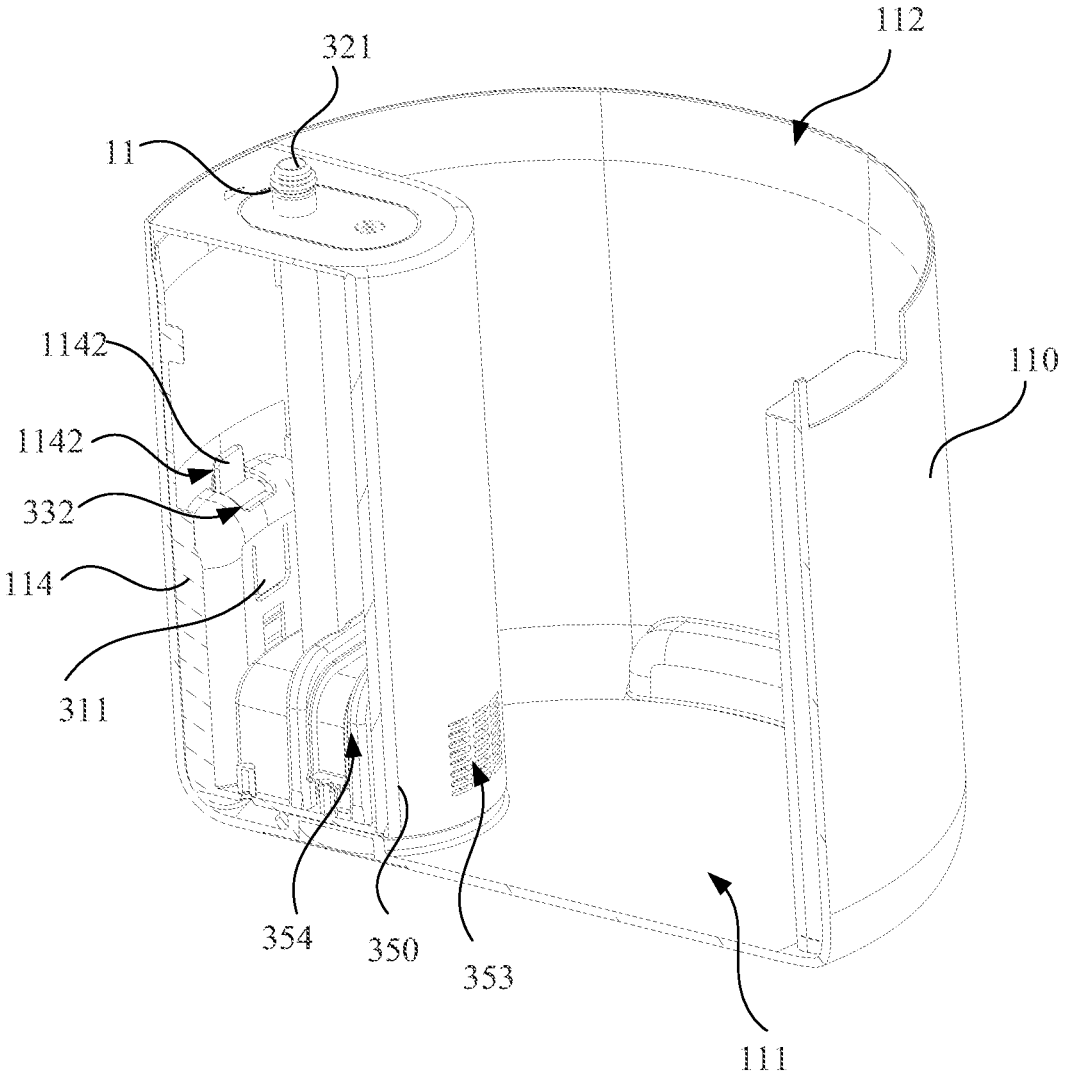
FIG. 4 is a schematic assembly diagram of the container and the water pump assembly shown in FIG. 1.

As shown in FIGS. 3 and 4, in conjunction with any one of the above embodiments, in some embodiments, one of the water pump assembly 300 and the container 110 is provided with a first limiting protrusion 114, and the other one is provided with a first limiting recess 330 fitted to the first limiting protrusion 114 in a limiting manner. In this way, the limiting fit of the first limiting recess 330 and the first limiting protrusion 114 allows for easy alignment of the water pump assembly 300 with the container 110 in a mounting process. Furthermore, the water pump assembly 300 and the container 110 are more firmly fixed to ensure that the water pump assembly 300 will not loosen during operation.

Alternatively, in some embodiments, the container 110 is provided with the first limiting protrusion 114 arranged on an inner side wall of the liquid storage cavity 111, and the first limiting protrusion 114 has a height direction extending in a depth direction of the liquid storage cavity 111. The stucking portion 113 includes a stucking groove 1131 arranged on the first limiting protrusion 114, the buckling portion 310 includes an elastic protrusion 311 snap-fitted to the stucking groove 1131, and the elastic protrusion 311 is arranged in the first limiting recess 330. In this way, in the process of assembling the water pump assembly 300, the limiting fit of the first limiting recess 330 and the first limiting protrusion 114 makes it easy to insert the water pump assembly 300 into the liquid storage cavity 111. Furthermore, in the process of inserting the water pump assembly 300 into the liquid storage cavity 111, the elastic protrusion 311 abuts against the first limiting protrusion 114 to elastically deform, and the elastic protrusion 311 elastically resets and inserts into the stucking groove 1131 in response to determining the elastic protrusion 311 is opposite the stucking groove 1131, so as to fix the water pump assembly 300. Under the action of elastic reset force, the elastic protrusion 311 collides with the first limiting protrusion 114 to send a prompt sound, so as to remind the user that the water pump assembly 300 is mounted in position, and further to improve the mounting convenience of the water pump assembly 300.

In conjunction with any one of the above embodiments of the first limiting protrusion 114, as shown in FIGS. 3 and 4, in some embodiments, the first limiting protrusion 114 is arranged on the container 110, the first limiting protrusion 114 includes a guide-in portion 1141 arranged away from a bottom of the container 110, the first limiting recess 330 is arranged on the water pump assembly 300, and the first limiting recess 330 is provided with a fitting groove 331 matched with the guide-in portion 1141. In this way, by means of the guide-in fit between the guide-in portion 1141 and the fitting groove 331, it is easy to guide the first limiting protrusion 114 into the first limiting recess 330, which is convenient for the user to align and improves the convenience of operation.

It is to be noted that a specific shape of the guide-in portion 1141 may be various, including but not limited to a rounded structure, a taper structure and a partial spherical structure.

As shown in FIGS. 3 and 4, further, in some embodiments, one of the guide-in portion 1141 and the fitting groove 331 is provided with a lug 1142, the other one is provided with a slot 332 fitted to the lug 1142 in an inserting manner, and the slot 332 is arranged away from a bottom of the water pump assembly 300. In this way, when the guide-in portion 1141 is inserted into the fitting groove 331, the lug 1142 is inserted into the slot 332, which forms a further limitation, so as to prevent the water pump assembly 300 from being pulled out in a width direction of the liquid storage cavity 111. The water pump assembly 300 is firmly fixed in the container 110 by the snap fit between the stucking groove 1131 and the elastic protrusion 311.

Further, in some embodiments, the lug 1142 protrudes from the guide-in portion 1141, and is spaced apart from a side wall of the container 110 to form a limiting groove 1143, the water pump assembly 300 is provided with the slot 332, and a part of the water pump assembly 300 is inserted into the limiting groove 1143. In this way, in a process that the first limiting protrusion 114 is inserted into the fitting groove 331 by means of the guide-in portion 1141, the lug 1142 is inserted into the slot 332, and the part of the water pump assembly 300 is inserted into the limiting groove 1143, such that the water pump assembly 300 is arranged to be closely attached to an inner side wall of the container 110, and it can be prevent the water pump assembly 300 from being pulled out in the width direction of the liquid storage cavity 111. Furthermore, by means of the snap fit of the elastic protrusion 311 and the stucking groove 1131, it can prevent the water pump assembly 300 from being easily pulled out in a direction from the bottom of the liquid storage cavity 111 to the opening 112, and the water pump assembly 300 can be firmly fixed in the container 110.

Specifically, in the process of assembling the water pump assembly 300 and the container 110, the first limiting protrusion 114 is guided into the fitting grooves 331 by means of the guide-in portion 1141, such that the first limiting protrusion 114 and the first limiting recess 330 are fitted in a limiting manner. In the process that the water pump assembly 300 is continuously inserted into the bottom of the liquid storage cavity 111, the lug 1142 may be inserted into the slot 332 to prevent the water pump assembly 300 from being pulled out in the width direction of the liquid storage cavity 111. When the water pump assembly 300 is inserted into the set position, the elastic protrusion 311 elastically resets and inserts into the stucking groove 1131, so as to prevent the water pump assembly 300 from being easily pulled out in a direction from the bottom of the liquid storage cavity 111 to the opening 112. Furthermore, the part of the water pump assembly 300 is inserted into the limiting groove 1143, such that the water pump assembly 300 is arranged to be closely attached to the inner side wall of the container 110, and the water pump assembly 300 is firmly fixed in the container 110.

When the water pump assembly 300 needs to be disassembled, it is only required to apply sufficient unlocking force in a direction from the bottom of the liquid storage cavity 111 to the opening 112, such that the elastic protrusion 311 is elastically deformed to be separated from the stucking groove 1131, and then the water pump assembly 300 can be pulled out to be maintained or cleaned.

In conjunction with the above embodiments, as shown in FIGS. 3 and 4, in some embodiments, the first limiting protrusion 114 further includes a first positioning portion 1144 connected to the lug 1142, the first positioning portion 1144 is arranged in the limiting groove 1143, and the water pump assembly 300 is provided with a first fitting portion fitted to the first positioning portion 1144 in a positioning manner. In this way, by means of the positioning fit between the first positioning portion 1144 and the first fitting portion, the tightness of connection between the water pump assembly 300 and the container 110 can be further improved, such that the water pump assembly 300 will not easily move during operation.

Alternatively, in some embodiments, the first positioning portion 1144 is a positioning ridge and is at right angle to the lug 1142, and the first fitting portion includes a positioning groove 333 fitted to the positioning ridge. In this way, the positioning ridge is connected to the lug 1142 and is at right angle to the lug 1142, so that the fit between the positioning ridge and the positioning groove 333 and the fit between the lug 1142 and the slot 332 can limit displacements of the water pump assembly 300 in at least two directions, and the water pump assembly 300 is closely connected to the container 110.

As shown in FIGS. 3 and 4, in conjunction with any one of the above embodiments, in some embodiments, one of a bottom of the water pump assembly 300 and a bottom of the container 110 is provided with a second limiting protrusion 340, and the other one is provided with a second limiting recess 115 fitted to the second limiting protrusion 340 in a limiting manner. In this way, by means of the limiting fit of the second limiting recess 115 and the second limiting protrusion 340, the bottom of the water pump assembly 300 and the bottom of the container 110 are reliably limited, and it is guaranteed that the water pump assembly 300 will not easily deflect during operation.

Further, in some embodiments, the second limiting protrusion 340 is arranged at the bottom of the water pump assembly 300, the second limiting recess 115 is provided with a notch 1151, the water pump assembly 300 is provided with a first water inlet hole 351 in communication with the liquid storage cavity 111, and the first water inlet hole 351 is arranged at the bottom of the water pump assembly 300 avoiding the second limiting protrusion 340. When the second limiting protrusion 340 and the second limiting recess 115 are fitted in a limiting manner, at least a part of the first water inlet hole 351 is arranged in the notch 1151. In this way, under the condition that the limiting fit between the second limiting protrusion 340 and the second limiting recess 115 guarantees that the bottom of the water pump assembly 300 and the bottom of the container 110 do not easily deflect, the liquid in the liquid storage cavity 111 can be better sucked conveniently through the first water inlet hole 351 arranged at the bottom of the water pump assembly 300.

Moreover, at least the part of the first water inlet hole 351 is arranged in the notch 1151. Thus, the limiting fit between the second limiting protrusion 340 and the second limiting recess 115 does not interfere with the water entry of the first water inlet hole 351, so as to reduce the residual liquid in the liquid storage cavity 111.

Figure 7:
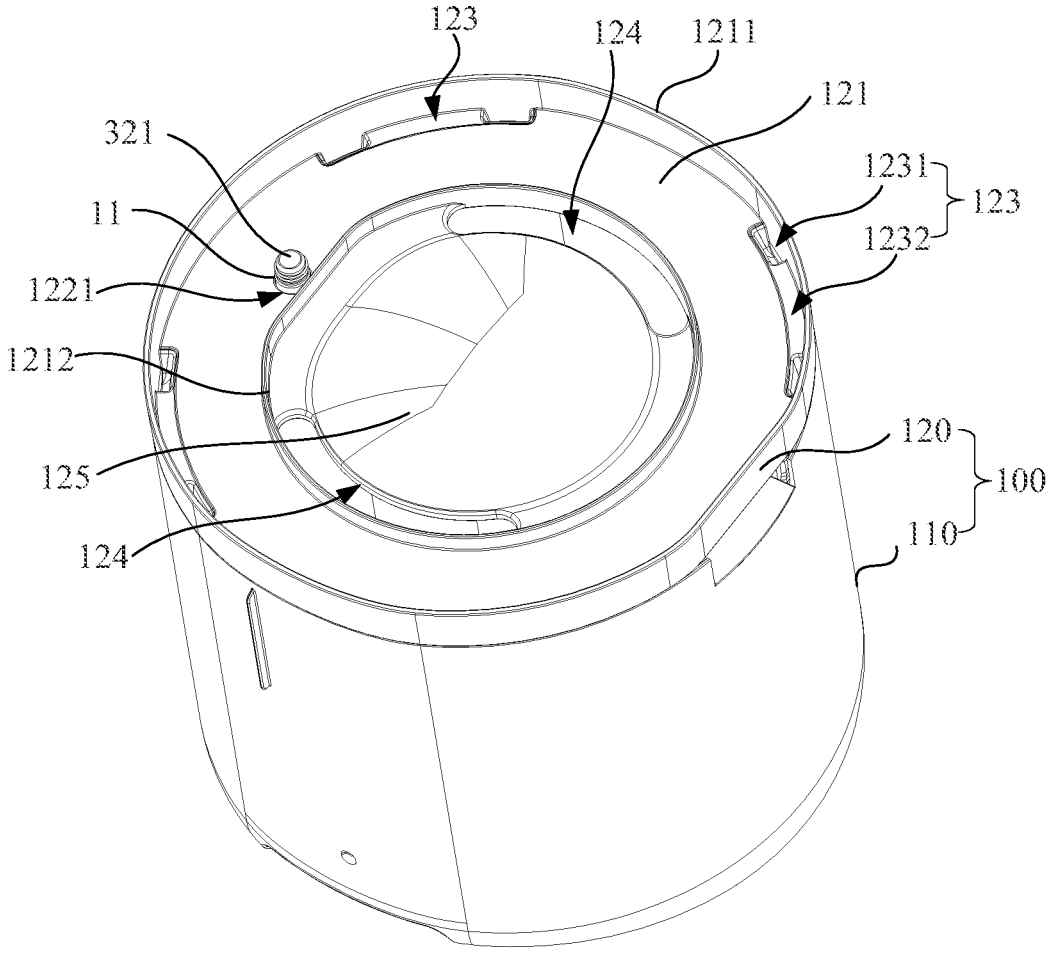
FIG. 7 is a schematic assembly diagram of a liquid storage assembly and a water pump assembly according to one embodiment.

In conjunction with any one of the above embodiments, as shown in FIGS. 1 and 7, in some embodiments, the butting portion 122 includes a port 1221, the liquid outlet end 320 includes an insertion head 321, and the insertion head 321 passes through the port 1221 and is fitted to the first pipe 210 in an inserting manner. In this way, after the water pump assembly 300 are mounted on the container 110, the mounting base 120 is mounted in a covering manner, such that the insertion head 321 passes through the port 1221 and protrudes from the mounting cavity 121, so as to be in communication with the first pipe 210 of the humidification assembly 200 in an inserting manner conveniently.

Moreover, by means of the inserting fit between the insertion head 321 and the first pipe 210, the humidification assembly 200 will not easily shake on the mounting base 120.

Figure 5:
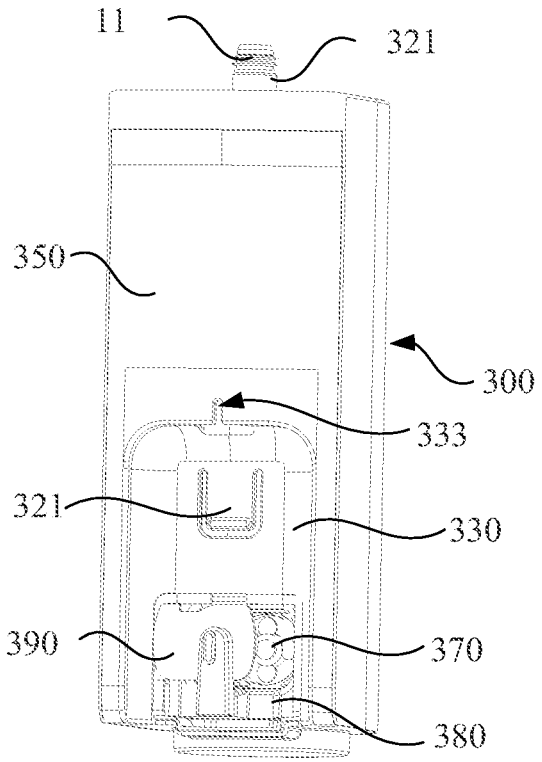
FIG. 5 is a schematic exploded view of a structure of the water pump assembly shown in FIG. 3.

Alternatively, as shown in FIGS. 4 and 5, in some embodiments, the humidification apparatus 10 further includes a sealing ring 11, the sealing ring 11 is arranged on at least one of the insertion head 321 and the first pipe 210, and is sandwiched between the insertion head 321 and an inner side wall of the first pipe 210. In this way, the insertion sealing performance of the first pipe 210 and the insertion head 321 is improved by means of the sealing ring 11, liquid leakage is avoided or reduced, and more liquid is pumped into the first pipe 210 conveniently, and flows into a body of the humidification assembly 200 through the first pipe 210.

Alternatively, in another embodiments, the butting portion 122 includes a connector, one end of the connector is fitted to the first pipe 210 in an inserting manner, and the other end of the connector is fitted to the liquid outlet end 320 in an inserting manner. In this way, after the water pump assembly 300 are mounted on the container 110, the mounting base 120 is mounted in a covering manner, and one end of the connector is fitted to the first pipe 210 in an inserting manner, so as to facilitate communication between the liquid outlet end 320 and the first pipe 210 of the humidification assembly 200.

Moreover, the connector is fitted to the first pipe 210 in an inserting manner, such that the humidification assembly 200 will not easily shake on the mounting base 120.

In conjunction with any one of the above embodiments, as shown in FIG. 1, in some embodiments, an end of the humidification assembly 200 is provided with a liquid guide groove 230, the liquid guide groove 230 is arranged away from the mounting cavity 121, one end of the first pipe 210 is in communication with the liquid outlet end 320, and the other end is in communication with the liquid guide groove 230.

In conjunction with any one of the above embodiments, as shown in FIGS. 3 and 5, in some embodiments, the water pump assembly 300 includes a protective housing 350, a protective cover 360 and an impeller assembly 370 arranged in the protective housing 350, the protective housing 350 is provided with a cleaning port 352 allowing the impeller assembly 370 to be cleaned, and the protective cover 360 shields the cleaning port 352 and is detachably connected to the protective housing 350. In this way, the protective cover 360 shields the cleaning port 352 and is detachably connected to the protective housing 350, so that the impeller assembly 370 can be protected in the protective housing 350. When the impeller assembly 370 needs to be cleaned, it is only necessary to remove the protective cover 360 to clean the impeller assembly 370 through the cleaning port 352, such that the water pump assembly 300 can be cleaned more completely.

Further, as shown in FIG. 5, in some embodiments, the water pump assembly 300 further includes a shock absorption sleeve 380 arranged in the protective housing 350, and an impeller cover 390 detachably connected to the shock absorption sleeve 380, and a part of the impeller assembly 370 is arranged in the shock absorption sleeve 380 and is sealed by the impeller cover 390. In this way, the impeller assembly 370 is accommodated by the shock absorption sleeve 380, which helps to reduce the noise generated by the water pump assembly 300 during operation, and improve the silence of the humidification apparatus 10. However, when the impeller assembly 370 needs to be cleaned, the impeller assembly can be cleaned by disassembling the protective cover 360 and the impeller cover 390.

In conjunction with any one of the above embodiments, as shown in FIG. 4, in some embodiments, a side wall of the water pump assembly 300 is provided with a second water inlet hole 353 in communication with the liquid storage cavity 111, and the water pump assembly 300 includes an electrolytic cavity 354 in communication with the second water inlet hole 353, and an electrolysis module (not shown) at least partially arranged in the electrolytic cavity 354. In this way, the liquid in the liquid storage cavity 111 may enter the electrolytic cavity 354 through the second water inlet hole 353, which allows the electrolysis module to electrolytically sterilize the liquid in the liquid storage cavity 111, and improve the sterile quality of air humidification.

Figure 6:
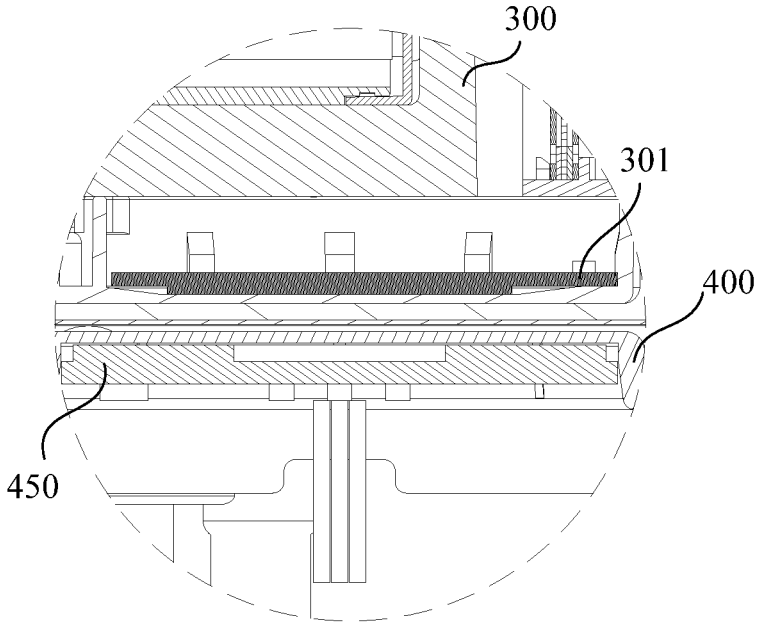
FIG. 6 is an enlarged schematic diagram of region A shown in FIG. 1.

As shown in FIG. 6, in some embodiments, the water pump assembly 300 is provided with a reception module 301, and the housing assembly 400 is provided with a transmission module 450 which is in cooperation with the reception module 301 for wireless power supply. In this way, power supply to the water pump assembly 300 may be implemented by means of the cooperation between the reception module 301 and the transmission module 450 for wireless power supply, which helps to reduce the difficulty of waterproof sealing of the humidification apparatus 10.

Figure 8:
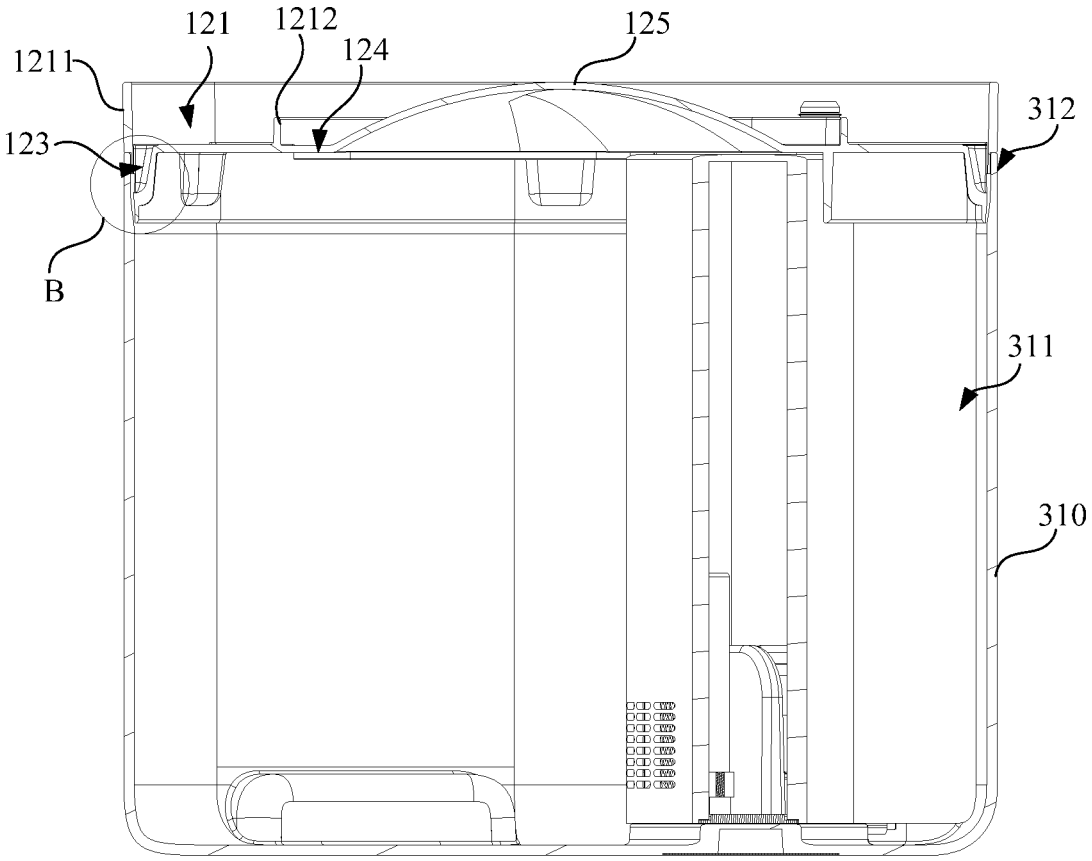
FIG. 8 is a schematic sectional view of a liquid storage assembly and a water pump assembly shown in FIG. 2.
Figure 9:
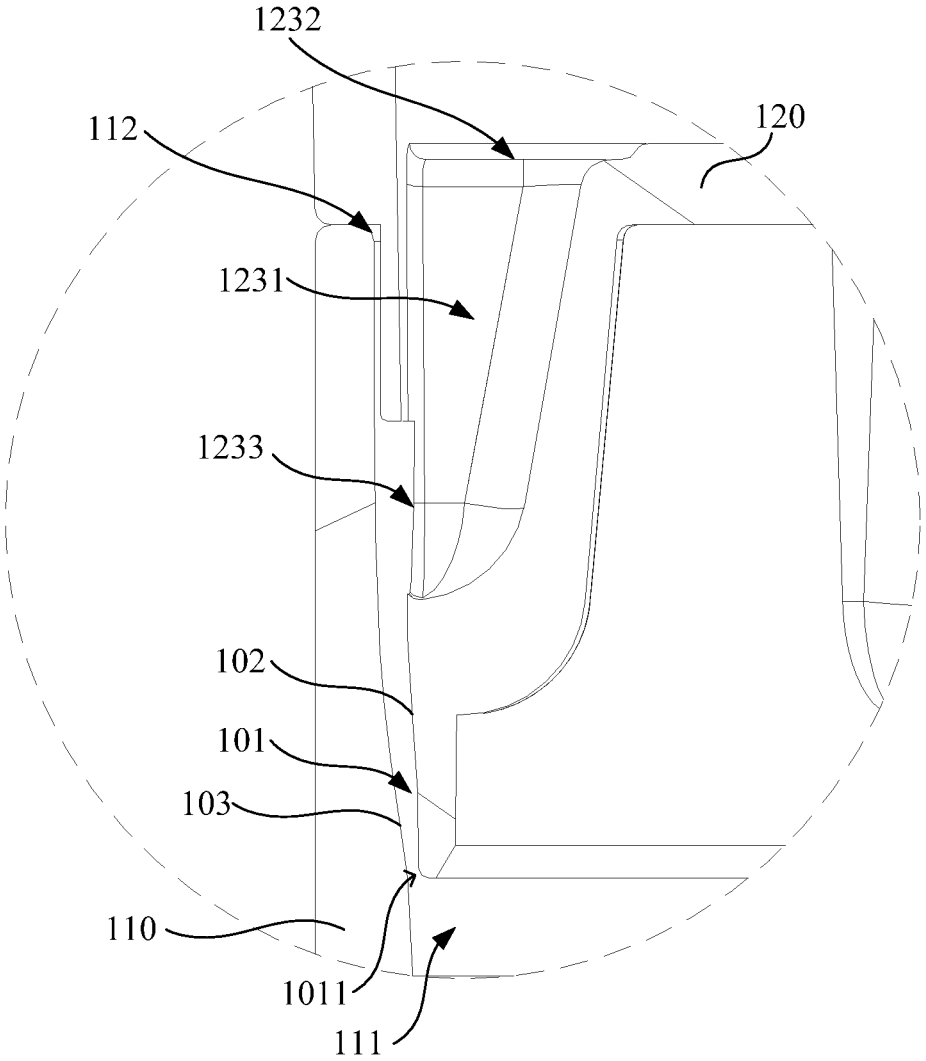
FIG. 9 is an enlarged schematic diagram of region B shown in FIG. 8.

On the basis of any one of the above embodiments, as shown in FIG. 7 to FIG. 9, in some embodiments, a silencing channel 101 is arranged between at least a part of a side wall of the mounting base 120 and an inner side wall of the liquid storage cavity 111, the mounting base 120 includes a mounting cavity 121 for accommodating the humidification assembly 200, the humidification assembly 200 is mounted on the mounting base 120 by means of the mounting cavity 121, the mounting cavity 121 is provided with a liquid leakage groove 123, the liquid leakage groove 123 is in communication with the liquid storage cavity 111 through the silencing channel 101, and the silencing channel 101 is configured to reduce a water sound generated by the liquid flowing from the liquid leakage groove 123 to the liquid storage cavity 111.

In this way, when the humidification apparatus 10 is in use, the humidification assembly 200 is mounted on the mounting base 120 by means of the mounting cavity 121. In the process of wetting the humidification assembly 200, excess liquid may flow from the liquid leakage groove 123 in the mounting cavity 121 into the liquid storage cavity 111 under the action of gravity. During the backflow of the liquid, the liquid leakage groove 123 is in communication with the liquid storage cavity 111 through the silencing channel 101, and when the water flows through the silencing channel 101, the water flows into the liquid storage cavity 111 along the inner side wall of the liquid storage cavity 111, which can avoid the generation of a water drop sound. In this way, the silencing channel 101 can reduce the water sound generated by the liquid flowing from the liquid leakage groove 123 to the liquid storage cavity 111, such that the backflow water sound of the liquid storage assembly 100 is small, which helps to improve a silencing effect of the humidification apparatus 10.

In conjunction with any one of the above embodiments, as shown in FIG. 9, in some embodiments the mounting base 120 includes a first silencing wall 102 arranged below the liquid leakage groove 123, the liquid storage cavity 111 is provided with a second silencing wall 103, and the second silencing wall 103 and the first silencing wall 102 are spaced to form the silencing channel 101. In this way, after the liquid flows out from the liquid leakage groove 123, the liquid continues to flow downwards along the first silencing wall 102, contact with the second silencing wall 103, and is silenced through the silencing channel 101 to avoid the generation of the water drop sound.

In conjunction with any one of the above embodiments, as shown in FIG. 9, in some embodiments, the first silencing wall 102 is arranged gradually close to the second silencing wall 103 in a depth direction of the liquid storage cavity 111. In this way, in a process that the liquid continuously flows downwards along the first silencing wall 102, the first silencing wall 102 is arranged gradually close to the second silencing wall 103 to better guide the liquid onto the second silencing wall 103, allowing the liquid to flow through the second silencing wall 103 and continuously flow downwards along the inner side wall of the liquid storage cavity 111 so as to avoid the generation of water drops.

In conjunction with any one of the above embodiments, in some embodiments, the second silencing wall 103 is arranged gradually close to the first silencing wall 102 in the depth direction of the liquid storage cavity 111. In this way, in a process that the liquid continuously flows downwards along the first silencing wall 102, the second silencing wall 103 is arranged gradually close to the first silencing wall 102 to better guide the liquid from the first silencing wall 102 onto the second silencing wall 103, allowing the liquid to flow through the second silencing wall 103 and continuously flow downwards along the inner side wall of the liquid storage cavity 111 so as to avoid the generation of water drops.

In some embodiments, the first silencing wall 102 is arranged gradually close to the second silencing wall 103 in the depth direction of the liquid storage cavity 111, and the second silencing wall 103 is arranged gradually close to the first silencing wall 102 in the depth direction of the liquid storage cavity 111. In this way, in a process that the liquid continuously flows downwards along the first silencing wall 102, the liquid is better guided from the first silencing wall 102 onto the second silencing wall 103. Moreover, the first silencing wall 102 is arranged gradually close to the second silencing wall 103, the second silencing wall 103 is arranged gradually close to the first silencing wall 102, which is also convenient to reduce a size of an outlet 1011 of the silencing channel 101 and form a water climbing wall effect, so that the liquid can flow through the second silencing wall 103 and continuously flows downwards along the inner side wall of the liquid storage cavity 111 to avoid the generation of water drops.

In conjunction with any one of the above embodiments of the first silencing wall 102, as shown in FIG. 7 and FIG. 9, in some embodiments, the liquid leakage groove 123 further includes a liquid leakage hole 1231, the mounting cavity 121 is in communication with the silencing channel 101 through the liquid leakage hole 1231, and the first silencing wall 102 is arranged below the liquid leakage hole 1231 and away from the mounting cavity 121. In this way, during the liquid is accumulating in the mounting cavity 121, the liquid flows into the liquid leakage hole 1231, and continuously flows downwards along the first silencing wall 102 through the liquid leakage hole 1231, thus silencing the liquid through the silencing channel 101 and further avoiding the generation of the water drop sound.

In conjunction with the above embodiments, in some embodiments, the liquid leakage groove 123 further includes a water collection groove 1232 in communication with the liquid leakage hole 1231. In this way, the water collection groove 1232 collects the liquid in the mounting cavity 121, and guides the liquid in the liquid leakage hole 1231, thus improving a liquid leakage effect of the mounting base 120.

In conjunction with any one of the above embodiments of the liquid leakage hole, as shown in FIG. 9, in some embodiments, the liquid leakage hole is provided with a first notch 1233 towards the inner side wall of the liquid storage cavity 111. In this way, the first notch 1233 faces the inner side wall of the liquid storage cavity 111, such that the liquid flowing out of the first notch 1233 can be easily guided into the silencing channel 101. In this process, the liquid may also be guided onto the second silencing wall 103 conveniently, so that the liquid continuously flows downwards along the inner side wall of the liquid storage cavity 111, to easily form a water climbing wall effect, and reduce or avoid the generation of water drops.

Figure 10:
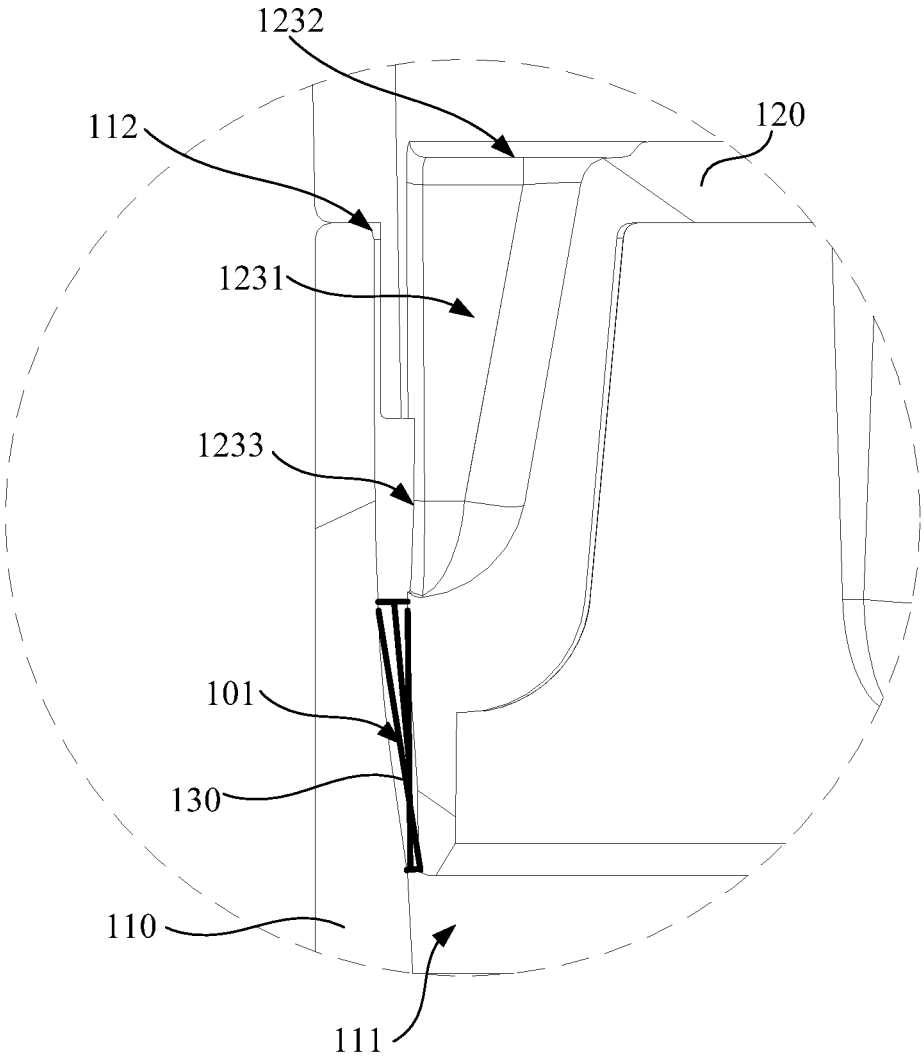
FIG. 10 is a schematic sectional view of a partial structure of a liquid storage assembly according to another embodiment.

It is to be noted that the silencing channel 101 may be specifically implemented in various forms. As shown in FIG. 10, in some other embodiments, the liquid storage assembly 100 further includes a porous material layer 130. The porous material layer 130 is provided with a silencing channel 101 and sandwiched between a part of the side wall of the mounting base 120 and an inner side wall of the liquid storage cavity 111. In this way, using the porous material layer 130 to form the silencing channel 101 can also reduce or avoid the noise caused by the direct dropping of water into the liquid storage cavity 111.

Specifically, after the liquid flows out from the liquid leakage groove 123, the liquid flows downwards slowly along the silencing channel 101 of the porous material layer 130, such that the liquid continuously flows downwards along the inner side wall of the liquid storage cavity 111 by means of the water climbing wall effect, thus preventing the generation of water drops.

In conjunction with any one of the above embodiments, in some embodiments, the mounting base 120 further includes a positioning portion (not shown) arranged in the mounting cavity 121, and the positioning portion is fitted to a fitting portion of the humidification assembly 200 in a positioning manner. In this way, the humidification assembly 200 is accommodated by the mounting cavity 121, and the positioning portion is positioned and matched with the fitting portion, so that the humidification assembly 200 is primarily fixed to the mounting base 120. It is also convenient to maintain consistent mounting positions of the humidification assembly 200 and the mounting base 120.

Alternatively, one of the positioning portion and the fitting portion is provided with a positioning protrusion, and the other one is provided with a positioning hole fitted to the positioning protrusion in a positioning manner.

In conjunction with any of the above embodiments, as shown in FIG. 9, in some embodiments, the silencing channel 101 includes an outlet 1011 in communication with the liquid storage cavity 111, and in a half-sectional view in the depth direction of the liquid storage cavity 111, a width of the outlet 1011 is L, 0.1 mm≤L≤1 mm. In this way, the outlet 1011 of the silencing channel 101 is limited to 0.1 mm≤L≤1 mm, so that the tension action of the water itself can be used to achieve the water climbing wall effect, which can make the water slowly flow into a water tank along the side wall of the water tank, preventing the generation of water drops and the water drop noise caused by the water dripping into the liquid storage cavity 111, achieve the silencing effect and further improving the quiet effect of the humidification apparatus 10.

In conjunction with any of the above embodiments, as shown in FIG. 7, in some embodiments, the mounting cavity 121 is at least partially annular, and there are at least two liquid leakage grooves 123 which are arranged at intervals in a circumferential direction of the mounting cavity 121. In this way, excess liquid flowing out of the humidification assembly 200 can better flow back into the liquid storage cavity 111 through the two liquid leakage grooves 123.

As shown in FIG. 7, in some embodiments, the liquid adding hole 124 is arranged to avoid the mounting cavity 121. In this way, in the process of adding water, the water flows through the columnar space 220 and flows into the liquid adding hole 124, and the liquid adding hole 124 is arranged to avoid the mounting cavity 121, such that the liquid does not pass through the humidification assembly 200, and a liquid adding speed is further improved.

In conjunction with any of the above embodiments, as shown in FIG. 7 and FIG. 8, in some embodiments, the mounting base 120 includes an inner retaining ring 1212 and an outer retaining ring 1211 surrounding the inner retaining ring 1212 to form the mounting cavity 121, the liquid leakage groove 123 is arranged between the inner retaining ring 1212 and the outer retaining ring 1211, and the liquid adding hole 124 is arranged at the inner side of the retaining ring 1212. In this way, the mounting cavity 121 is formed by the fit of the inner retaining ring 1212 and the outer retaining ring 1211, such that the humidification assembly 200 can be restrained by the inner retaining ring 1212 and the outer retaining ring 1211. The liquid leakage groove 123 is arranged between the inner retaining ring 1212 and the outer retaining ring 1211, and the liquid adding hole 124 is arranged at the inner side of the retaining ring 1212, such that the liquid adding channel 402 and a backflow channel are separated by the inner retaining ring 1212 and do not interfere with each other.

Particularly, in a liquid adding process, the inner retaining ring 1212 is configured to prevent the liquid from making contact with the humidification assembly 200, so as to prevent the humidification assembly 200 from interfering with the liquid and thus influencing the liquid adding speed.

In conjunction with any one of the above embodiments, as shown in FIGS. 7 and FIG. 8, in some embodiments, the mounting base 120 further includes a liquid guide protrusion 125, the liquid guide protrusion 125 is arranged at the inner side of the retaining ring 1212, and the liquid adding hole 124 is arranged between the liquid guide protrusion 125 and the inner retaining ring 1212. In this way, the liquid is guided to the liquid adding hole 124 by the liquid guide protrusion 125, such that the liquid is conveniently conveyed to the liquid storage cavity 111 through the liquid adding hole 124.

It is to be noted that "inner retaining ring" may be "a part of a mounting base", that is, the "inner retaining ring" and "other parts of the mounting base, for example, an outer retaining ring or a liquid guide protrusion" are integrally formed and manufactured; and the "inner retaining ring" may also be an independent component that can be separated from the "other parts of the mounting base, for example, an outer retaining ring or a liquid guide protrusion", that is, the "inner retaining ring" may be independently manufactured, and then combined with the "other parts of the mounting base, for example, an outer retaining ring or a liquid guide protrusion" into a whole.

Similarly, "portion" may be a part of corresponding "component", that is, "body" and "portion" are integrally formed with "other parts of the component"; and the "body" and the "portion" may also be an independent component that may be separated from "other parts of the component", that is, the "body" and the "portion" may be manufactured independently, and then combined with the "other parts of the component" into a whole. In the present disclosure, the expression of the above "body" and "portion" is merely one of the embodiments for ease of reading, instead of a limitation on the scope of protection of the present disclosure. As long as the above features are included and their functions are the same, the expression should be understood as the equivalent technical solutions of the present disclosure.

It is to be noted that components included in an "assembly" or "apparatus" of the present disclosure may also be flexibly combined, that is, may be subjected to modular production according to actual practice and assembled as an independent module; and the components may also be assembled separately to form a module in the device. In the present disclosure, the division of the above components is merely one of the embodiments for ease of reading, instead of a limitation on the scope of protection of the present disclosure. As long as the above components are included and their functions are the same, the division should be understood as the equivalent technical solutions of the present disclosure.

In the description of the present disclosure, it is to be understood that the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc. indicated azimuthal or positional relations are based on those shown in the drawings and are only intended to ease of description of the present disclosure and simplify the description, but not intended to indicate or imply that the referenced device or element must have a particular orientation and be constructed and operative in a particular orientation, and thus may not be construed as a limitation on the present disclosure.

Moreover, the terms "first", "second", etc. are for descriptive purposes only and are not to be construed as indicating or implying relative importance or implicitly specifying the number of indicated technical features. Thus, a feature defined with "first", "second", etc. may explicitly or implicitly include at least one the feature. In the description of the present disclosure, "plurality" means two or more, for example, two, three, etc., unless expressly defined otherwise.

In the present disclosure, unless otherwise clearly specified, the terms "mount", "connect", "connection", "fix", etc. should be understood in a board sense. For example, the connection may be a fixed connection, a detachable connection, an integral connection, a mechanical connection, an electrical connection, a direct connection, or an indirect connection via an intermediate medium, or may be intercommunication between two elements, or an interaction relation between two elements, unless expressly defined otherwise. For those ordinary skilled in the art, the specific meaning of the above terms in the present disclosure can be understood according to specific circumstances.

In the description of the present disclosure, unless expressly specified and defined otherwise, a first feature being "on" or "under" a second feature may mean that the first feature makes direct contact with the second feature or that the first feature makes indirect contact with the second feature by means of an intermediary medium. Further, a first feature being "over", "above" and "on top of" a second feature may mean that the first feature is above the second feature exactly or not, or merely mean that the first feature is higher than the second feature. A first feature being "under". "below" and "on bottom of" a second feature may mean that the first feature is below the second feature exactly or not, or merely mean that the first feature is lower than the second feature.

It is to be noted that when an element is referred to as being "fixed to", "arranged on", "fixedly arranged on" or "mounted on" another element, the element may be directly on another element or may be indirectly on another element by means of an intermediate element. When an element is considered to be "connected" to another element, the element may be directly connected to another element or may be indirectly connected to another element by means of an intermediate element. Further, when an element is considered to be "in fixed transmission connection to" another element, the two elements may be fixed in a detachable connection manner, or may also be fixed in a non-detachable connection manner, for example, a sleeving manner, a stucking manner, an integral forming and fixing manner, a welding manner, etc. that can be implemented by means of traditional technologies as long as power transmission may be implemented, which will not be described in detail here. When an element is perpendicular or nearly perpendicular to another element, it means that an ideal state of the two elements is perpendicular, but there can be some vertical error due to manufacturing and assembly. The terms "perpendicular", "horizontal", "left", "right" and similar expressions as used here are for illustrative purposes merely and do not mean the only embodiments.

The various technical features of the embodiments described above may be arbitrarily combined, and not all possible combinations of the various technical features in the embodiments described above are described for brevity of description. However, to the extent that there is no contradiction in the combination of the technical features, the combination should be considered to fall within the scope of the description.

The embodiments described above describe only a few embodiments of the present disclosure, which are specific and detailed in description, but cannot be construed as a limitation on the scope of the invention patent accordingly. It should be noted that several modifications and improvements may also be made to those ordinary skilled in the art without departing from the inventive concept of the present disclosure, which fall within the scope of protection of the present disclosure.

Embodiments

1. A humidification apparatus, including:
a liquid storage assembly, including:
a container provided with a liquid storage cavity and an opening in communication with the liquid storage cavity, where the container further includes a stucking portion arranged in the liquid storage cavity; and
a mounting base detachably connected to the container, where at least a part of the mounting base is configured to cover the opening, and the mounting base includes a mounting cavity and a butting portion arranged in the mounting cavity;
a humidification assembly, provided with a first pipe, where a part of the humidification assembly is mounted in the mounting cavity; and
a water pump assembly, including a buckling portion and a liquid outlet end, where the buckling portion is snap-fitted to the stucking portion such that the water pump assembly is arranged in the liquid storage cavity, and the liquid outlet end is in communication with the first pipe by means of the butting portion.
2. A second embodiment includes the humidification apparatus of embodiment 1, where one of the water pump assembly and the container is provided with a first limiting protrusion, and the other one of the water pump assembly and the container is provided with a first limiting recess fitted to the first limiting protrusion in a limiting manner.
3. A third embodiment includes the humidification apparatus of embodiment 2, where the container is provided with the first limiting protrusion arranged on an inner side wall of the liquid storage cavity, the first limiting protrusion has a height direction extending in a depth direction of the liquid storage cavity, the stucking portion includes a stucking groove arranged on the first limiting protrusion, the buckling portion includes an elastic protrusion snap-fitted to the stucking groove, and the elastic protrusion is arranged in the first limiting recess.
4. A fourth embodiment includes the humidification apparatus of embodiment 2, where the first limiting protrusion is arranged on the container, the first limiting protrusion includes a guide-in portion arranged away from a bottom of the container, the first limiting recess is arranged on the water pump assembly, and the first limiting recess is provided with a fitting groove matched with the guide-in portion.
5. A fifth embodiment includes the humidification apparatus of embodiment 4, where one of the guide-in portion and the fitting groove is provided with a lug, the other one of the guide-in portion and the fitting groove is provided with a slot fitted to the lug in an inserting manner, and the slot is arranged away from a bottom of the water pump assembly.
6. A sixth embodiment includes the humidification apparatus of embodiment 5, where the lug is provided protruding from the guide-in portion, and is spaced apart from a side wall of the container to form a limiting groove, the first limiting recess is provided with the slot, and a part of the water pump assembly is inserted into the limiting groove.
7. A seventh embodiment includes the humidification apparatus of embodiment 6, where the first limiting protrusion further includes a first positioning portion connected to the lug, the first positioning portion is arranged in the limiting groove, and the water pump assembly is provided with a first fitting portion fitted to the first positioning portion in a positioning manner.
8. A eighth embodiment includes the humidification apparatus of embodiment 7, where the first positioning portion is a positioning ridge and is at right angle to the lug, and the first fitting portion includes a positioning groove fitted to the positioning ridge.
9. A ninth embodiment includes the humidification apparatus of any one of embodiments 1 to 8, where one of a bottom of the water pump assembly and a bottom of the container is provided with a second limiting protrusion, and the other one of the bottom of the water pump assembly and the bottom of the container is provided with a second limiting recess fitted to the second limiting protrusion in a limiting manner.
10. A tenth embodiment includes the humidification apparatus of embodiment 9, where the second limiting protrusion is arranged at the bottom of the water pump assembly, the second limiting recess is provided with a notch, the water pump assembly is provided with a first water inlet hole in communication with the liquid storage cavity, and the first water inlet hole is arranged at the bottom of the water pump assembly avoiding the second limiting protrusion; and at least a part of the first water inlet hole is arranged in the notch in case the second limiting protrusion and the second limiting recess are fitted in a limiting manner.
11. A eleventh embodiment includes the humidification apparatus of any one of embodiments 1 to 10, where the butting portion includes a port, the liquid outlet end includes an insertion head, and the insertion head is configured to pass through the port and is fitted to the first pipe in an inserting manner.
12. A twelfth embodiment includes the humidification apparatus of any one of embodiments 1 to 10, where the butting portion includes a connector, one end of the connector is fitted to the first pipe in an inserting manner, and the other end of the connector is fitted to the liquid outlet end in an inserting manner.
13. A thirteenth embodiment includes the humidification apparatus of embodiment 11, where the humidification apparatus further includes a sealing ring, where the sealing ring is arranged on at least one of the insertion head and the first pipe, and is sandwiched between the insertion head and an inner side wall of the first pipe.

14. A fourteenth embodiment includes the humidification apparatus of any one of embodiments 1 to 13, where an end of the humidification assembly is provided with a liquid guide groove, the liquid guide groove is arranged away from the mounting cavity, one end of the first pipe is in communication with the liquid outlet end, and the other end of the first pipe is in communication with the liquid guide groove.

15. A fifteenth embodiment includes the humidification apparatus of any one of embodiments 1 to 14, where the water pump assembly includes a protective housing, a protective cover and an impeller assembly arranged in the protective housing, the protective housing is provided with a cleaning port allowing the impeller assembly to be cleaned, and the protective cover is configured to shield the cleaning port and is detachably connected to the protective housing.

16. A sixteenth embodiment includes the humidification apparatus of embodiment 15, where the water pump assembly further includes a shock absorption sleeve arranged in the protective housing, and an impeller cover detachably connected to the shock absorption sleeve, and a part of the impeller assembly is arranged in the shock absorption sleeve and is sealed by the impeller cover.

17. A seventeenth embodiment includes the humidification apparatus of any one of embodiments 1 to 16, where a side wall of the water pump assembly is provided with a second water inlet hole in communication with the liquid storage cavity, and the water pump assembly includes an electrolytic cavity in communication with the second water inlet hole, and an electrolysis module at least partially arranged in the electrolytic cavity.

18. A eighteenth embodiment includes the humidification apparatus of any one of embodiments 1 to 117, where the humidification apparatus further includes:

a housing assembly provided with an air inlet hole and an air outlet, where an interior of the housing assembly is hollow to form a first accommodating cavity and a second accommodating cavity, the first accommodating cavity is close to the air outlet, and the second accommodating cavity is located below the first accommodating cavity; and an airflow drive assembly arranged in the first accommodating cavity and configured to drive external air to enter the first accommodating cavity through the air inlet hole and to be discharged from the air outlet;

where the humidification assembly is arranged in the first accommodating cavity and is located below the airflow drive assembly, and the humidification assembly is configured to humidify air flowing therethrough; the liquid storage assembly is arranged in the second accommodating cavity, and the liquid storage assembly is configured to supply liquid; and the water pump assembly is configured to convey liquid in the liquid storage assembly to the humidification assembly, so as to wet the humidification assembly.

19. A nineteenth embodiment includes the humidification apparatus of embodiment 18, where the water pump assembly is provided with a reception module, and the housing assembly is provided with a transmission module which is in cooperation with the reception module for wireless power supply;

20. A twentieth embodiment includes the humidification apparatus of embodiment 18 or 19, where the humidification assembly is formed as tubular, and an interior of the humidification assembly is provided with a columnar space; the air inlet hole is arranged at a side wall of the housing assembly, and the air outlet is arranged at a top of the housing assembly; and the air inlet hole, the humidification assembly, the columnar space, the airflow drive assembly and the air outlet are in communication in sequence to form an air duct.

21. A twenty-first embodiment includes the humidification apparatus of embodiment 20, where a flow channel is formed between a housing of the airflow drive assembly and an inner wall of the housing assembly; the mounting base of the liquid storage assembly is provided with a liquid adding hole; and the air outlet, the flow channel, the columnar space and the liquid adding hole are in communication in sequence to form a liquid adding channel.

22. A twenty-second embodiment includes the humidification apparatus of any one of embodiments 1 to 21, where a silencing channel is arranged between at least a part of a side wall of the mounting base and an inner side wall of the liquid storage cavity, the mounting cavity is provided with a liquid leakage groove, the liquid leakage groove is in communication with the liquid storage cavity through the silencing channel, and the silencing channel is configured to reduce a water sound generated by a liquid flowing from the liquid leakage groove to the liquid storage cavity.

23. A twenty-third embodiment includes the humidification apparatus of embodiment 22, where the mounting base includes a first silencing wall arranged below the liquid leakage groove, the liquid storage cavity is provided with a second silencing wall, and the second silencing wall and the first silencing wall are spaced to form the silencing channel.

What is claimed is:

1. A humidification apparatus, comprising:

a liquid storage assembly, comprising:

a container provided with a liquid storage cavity and an opening in communication with the liquid storage cavity, wherein the container further comprises a stucking portion arranged in the liquid storage cavity; and a mounting base detachably connected to the container, wherein at least a part of the mounting base is configured to cover the opening, and the mounting base comprises a mounting cavity and a butting portion arranged in the mounting cavity;

a humidification assembly, provided with a first pipe, wherein a part of the humidification assembly is mounted in the mounting cavity; and a water pump assembly, comprising a buckling portion and a liquid outlet end, wherein the buckling portion is snap-fitted to the stucking portion such that the water pump assembly is arranged in the liquid storage cavity, and the liquid outlet end is in communication with the first pipe by means of the butting portion.

2. The humidification apparatus according to claim 1, wherein one of the water pump assembly and the container is provided with a first limiting protrusion, and the other one of the water pump assembly and the container is provided with a first limiting recess fitted to the first limiting protrusion in a limiting manner.

3. The humidification apparatus according to claim 2, wherein the container is provided with the first limiting protrusion arranged on an inner side wall of the liquid storage cavity, the first limiting protrusion has a height direction extending in a depth direction of the liquid storage cavity, the stucking portion comprises a stucking groove arranged on the first limiting protrusion, the buckling portion comprises an elastic protrusion snap-fitted to the stucking groove, and the elastic protrusion is arranged in the first limiting recess.

4. The humidification apparatus according to claim 2, wherein the first limiting protrusion is arranged on the container, the first limiting protrusion comprises a guide-in portion arranged away from a bottom of the container, the first limiting recess is arranged on the water pump assembly, and the first limiting recess is provided with a fitting groove matched with the guide-in portion.

5. The humidification apparatus according to claim 4, wherein one of the guide-in portion and the fitting groove is provided with a lug, the other one of the guide-in portion and the fitting groove is provided with a slot fitted to the lug in an inserting manner, and the slot is arranged away from a bottom of the water pump assembly.

6. The humidification apparatus according to claim 5, wherein the lug is provided protruding from the guide-in portion, and is spaced apart from a side wall of the container to form a limiting groove, the first limiting recess is provided with the slot, and a part of the water pump assembly is inserted into the limiting groove.

7. The humidification apparatus according to claim 6, wherein the first limiting protrusion further comprises a first positioning portion connected to the lug, the first positioning portion is arranged in the limiting groove, and the water pump assembly is provided with a first fitting portion fitted to the first positioning portion in a positioning manner.

8. The humidification apparatus according to claim 7, wherein the first positioning portion is a positioning ridge and is at right angle to the lug, and the first fitting portion comprises a positioning groove fitted to the positioning ridge.

9. The humidification apparatus according to claim 1, wherein one of a bottom of the water pump assembly and a bottom of the container is provided with a second limiting protrusion, and the other one of the bottom of the water pump assembly and the bottom of the container is provided with a second limiting recess fitted to the second limiting protrusion in a limiting manner.

10. The humidification apparatus according to claim 9, wherein the second limiting protrusion is arranged at the bottom of the water pump assembly, the second limiting recess is provided with a notch, the water pump assembly is provided with a first water inlet hole in communication with the liquid storage cavity, and the first water inlet hole is arranged at the bottom of the water pump assembly avoiding the second limiting protrusion; and at least a part of the first water inlet hole is arranged in the notch in case the second limiting protrusion and the second limiting recess are fitted in a limiting manner.

11. The humidification apparatus according to claim 1, wherein the butting portion comprises a port, the liquid outlet end comprises an insertion head, and the insertion head is configured to pass through the port and is fitted to the first pipe in an inserting manner;

or, the butting portion comprises a connector, one end of the connector is fitted to the first pipe in an inserting manner, and the other end of the connector is fitted to the liquid outlet end in an inserting manner.

12. The humidification apparatus according to claim 11, wherein the humidification apparatus further comprises a sealing ring, wherein the sealing ring is arranged on at least one of the insertion head and the first pipe, and is sandwiched between the insertion head and an inner side wall of the first pipe.

13. The humidification apparatus according to claim 1, wherein an end of the humidification assembly is provided with a liquid guide groove, the liquid guide groove is arranged away from the mounting cavity, one end of the first pipe is in communication with the liquid outlet end, and the other end of the first pipe is in communication with the liquid guide groove.

14. The humidification apparatus according to claim 1, wherein the water pump assembly comprises a protective housing, a protective cover and an impeller assembly arranged in the protective housing, the protective housing is provided with a cleaning port allowing the impeller assembly to be cleaned, and the protective cover is configured to shield the cleaning port and is detachably connected to the protective housing.

15. The humidification apparatus according to claim 14, wherein the water pump assembly further comprises a shock absorption sleeve arranged in the protective housing, and an impeller cover detachably connected to the shock absorption sleeve, and a part of the impeller assembly is arranged in the shock absorption sleeve and is sealed by the impeller cover.

16. The humidification apparatus according to claim 1, wherein the humidification apparatus further comprises:

a housing assembly provided with an air inlet hole and an air outlet, wherein an interior of the housing assembly is hollow to form a first accommodating cavity and a second accommodating cavity, the first accommodating cavity is close to the air outlet, and the second accommodating cavity is located below the first accommodating cavity; and an airflow drive assembly arranged in the first accommodating cavity and configured to drive external air to enter the first accommodating cavity through the air inlet hole and to be discharged from the air outlet;

wherein the humidification assembly is arranged in the first accommodating cavity and is located below the airflow drive assembly, and the humidification assembly is configured to humidify air flowing therethrough; the liquid storage assembly is arranged in the second accommodating cavity, and the liquid storage assembly is configured to supply liquid; and the water pump assembly is configured to convey liquid in the liquid storage assembly to the humidification assembly, so as to wet the humidification assembly.

17. The humidification apparatus according to claim 16, wherein the water pump assembly is provided with a reception module, and the housing assembly is provided with a transmission module which is in cooperation with the reception module for wireless power supply;

and/or, the humidification assembly is formed as tubular, and an interior of the humidification assembly is provided with a columnar space; the air inlet hole is arranged at a side wall of the housing assembly, and the air outlet is arranged at a top of the housing assembly; and the air inlet hole, the humidification assembly, the columnar space, the airflow drive assembly and the air outlet are in communication in sequence to form an air duct.

18. The humidification apparatus according to claim 17, wherein a flow channel is formed between a housing of the airflow drive assembly and an inner wall of the housing assembly; the mounting base of the liquid storage assembly is provided with a liquid adding hole; and the air outlet, the flow channel, the columnar space and the liquid adding hole are in communication in sequence to form a liquid adding channel.

19. The humidification apparatus according to claim 1, wherein a silencing channel is arranged between at least a part of a side wall of the mounting base and an inner side wall of the liquid storage cavity, the mounting cavity is provided with a liquid leakage groove, the liquid leakage groove is in communication with the liquid storage cavity through the silencing channel, and the silencing channel is configured to reduce a water sound generated by a liquid flowing from the liquid leakage groove to the liquid storage cavity.

20. The humidification apparatus according to claim 19, wherein the mounting base comprises a first silencing wall arranged below the liquid leakage groove, the liquid storage cavity is provided with a second silencing wall, and the second silencing wall and the first silencing wall are spaced to form the silencing channel.

* * * * *